US008738168B2

(12) United States Patent
Naka et al.

(10) Patent No.: US 8,738,168 B2
(45) Date of Patent: May 27, 2014

(54) SEWING MACHINE

(71) Applicants: Takafumi Naka, Ama (JP); Hidenori Oka, Tokai (JP)

(72) Inventors: Takafumi Naka, Ama (JP); Hidenori Oka, Tokai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/689,114

(22) Filed: Nov. 29, 2012

(65) Prior Publication Data

US 2013/0139739 A1 Jun. 6, 2013

(30) Foreign Application Priority Data

Dec. 5, 2011 (JP) ..... 2011-265663

(51) Int. Cl.
*D05C 5/00* (2006.01)

(52) U.S. Cl.
USPC ..... 700/136

(58) Field of Classification Search
USPC ..... 700/136–139
See application file for complete search history.

(56) References Cited

U.S. PATENT DOCUMENTS 4,124,285 A * 11/1978 Johnson et al. ..... 353/28
4,270,473 A * 6/1981 Brienza ..... 112/445
4,341,170 A * 7/1982 Beckerman et al. ..... 112/445
4,577,574 A * 3/1986 Takahashi ..... 112/445
4,664,048 A * 5/1987 Naganuma et al. ..... 112/453
4,821,657 A * 4/1989 Herdeg et al. ..... 112/470.04
4,960,061 A * 10/1990 Tajima et al. ..... 112/103
4,966,090 A * 10/1990 Tanaka et al. ..... 112/456
4,998,489 A * 3/1991 Hisatake et al. ..... 112/103
5,000,105 A * 3/1991 Tanaka ..... 112/453
5,042,410 A * 8/1991 Nakashima ..... 112/445
5,072,680 A * 12/1991 Nakashima ..... 112/445
5,195,451 A * 3/1993 Nakashima ..... 112/102.5

(Continued)

FOREIGN PATENT DOCUMENTS

JP A-2001-198372 7/2001
JP A-2008-212321 9/2008

(Continued)

OTHER PUBLICATIONS

Dec. 10, 2013 Office Action issued in Japanese Patent Application No. 2011-265663 (with translation).

*Primary Examiner* — Danny Worrell
(74) *Attorney, Agent, or Firm* — Oliff PLC

(57) ABSTRACT

A sewing machine includes a display, a projection portion, a processor, and a memory. The display is configured to display display information related to sewing. The projection portion is configured to project a mark having a predetermined shape toward a sewing machine bed. The memory is configured to store computer-readable instructions therein that, when executed by the processor, cause the sewing machine to project, by the projection portion, the mark toward the sewing machine bed, and display by the display, mark display information that represents the mark and stitch type display information of a planned stitch type to be sewn, in a first positional relationship that corresponds to a second positional relationship between the position of the planned stitch type to be sewn and the position of the mark configured to be projected on the sewing machine bed.

6 Claims, 13 Drawing Sheets

(56) References Cited

U.S. PATENT DOCUMENTS

| | | | | |
|---|---|---|---|---|
| 6,161,491 | A * | 12/2000 | Takenoya et al. | 112/102.5 |
| 6,176,189 | B1 | 1/2001 | Tomita | |
| 6,715,435 | B1 * | 4/2004 | Wieczorek et al. | 112/475.03 |
| 6,732,668 | B2 * | 5/2004 | Zesch et al. | 112/102.5 |
| 6,859,679 | B1 * | 2/2005 | Smith et al. | 700/138 |
| 7,212,880 | B2 * | 5/2007 | Mizuno et | 700/138 |
| 7,854,209 | B2 * | 12/2010 | Yamasaki | 112/444 |
| 8,463,420 | B2 * | 6/2013 | Tokura | 700/137 |
| 8,527,083 | B2 * | 9/2013 | Tokura | 700/138 |
| 2009/0025621 | A1 | 1/2009 | Matsuzawa | |

FOREIGN PATENT DOCUMENTS

| | | |
|---|---|---|
| JP | A-2009-000272 | 1/2009 |
| JP | A-2009-134561 | 6/2009 |
| JP | A-2009-207734 | 9/2009 |

* cited by examiner

SEWING MACHINE

CROSS-REFERENCE TO RELATED APPLICATION

This application claims priority to Japanese Patent Application No. 2011-265663, filed Dec. 5, 2011, the content of which is hereby incorporated herein by reference in its entirety.

BACKGROUND

The present disclosure relates to a sewing machine that may project a mark that serves as a reference for positioning a work cloth in a case where a stitch is sewn on the work cloth.

A sewing machine is known that may project a mark that may serve as a reference for positioning a work cloth in a case where a stitch is sewn on the work cloth. The sewing machine includes a mark projection device that may project a point mark that is configured from a slit beam along a Y axis and a slit beam along an X axis, for example. The mark projection device may project the point mark to indicate a reference position for positioning a cloth (the equivalent of the work cloth) that is placed on a sewing machine table. In a case where the angle at which the mark projection device projects the point mark has changed in relation to the sewing machine table, the light output may be changed in accordance with the angle. This causes the brightness of the point mark that is projected toward the sewing machine table to become substantially the same as the brightness was before the angle changed. A sewing machine is also known that includes a projection member that may indicate a needle drop point of a sewing needle. The projection member may be attached to a needle bar supporting platform. The needle bar supporting platform may be supported by a spindle that is affixed to a machine frame such that the needle bar supporting platform can swing. The needle bar supporting platform may support a needle bar, on a lower end of which the sewing needle may be mounted, such that the needle bar can move up and down. Therefore, in conjunction with the movement of needle drop point of the sewing needle, that is, in conjunction with the swinging of the needle bar supporting platform, the sewing machine can move the indicating position that the projection member projects.

SUMMARY

In a case where the sewing machines that are described above are used, it may be difficult for a user to understand the positional relationship between the projected mark and the stitch type for which sewing is planned (hereinafter referred to as a planned stitch type), even though the user can check the needle drop point and the positioning of the work cloth. Therefore, the operating efficiency may decrease in a case where the work cloth is being positioned.

Various embodiments of the broad principles derived herein provide a sewing machine in which the positional relationship between the projected mark and the planned stitch type can be checked easily.

Embodiments provide a sewing machine includes a display portion, a projection portion, a processor, and a memory. The display is configured to display display information related to sewing. The projection portion is configured to project a mark having a predetermined shape toward a sewing machine bed. The sewing machine bed includes a needle plate. The memory is configured to store computer-readable instructions therein that, when executed by the processor, cause the sewing machine to project, by the projection portion, the mark toward the sewing machine bed, and display by the display, mark display information that represents the mark and stitch type display information of a planned stitch type to be sewn, in a first positional relationship that corresponds to a second positional relationship between the position of the planned stitch type to be sewn and the position of the mark configured to be projected on the sewing machine bed. The stitch type display information represents a shape of a stitch type.

BRIEF DESCRIPTION OF THE DRAWINGS

Embodiments will be described below in detail with reference to the accompanying drawings in which.

DETAILED DESCRIPTION

Figure 1:
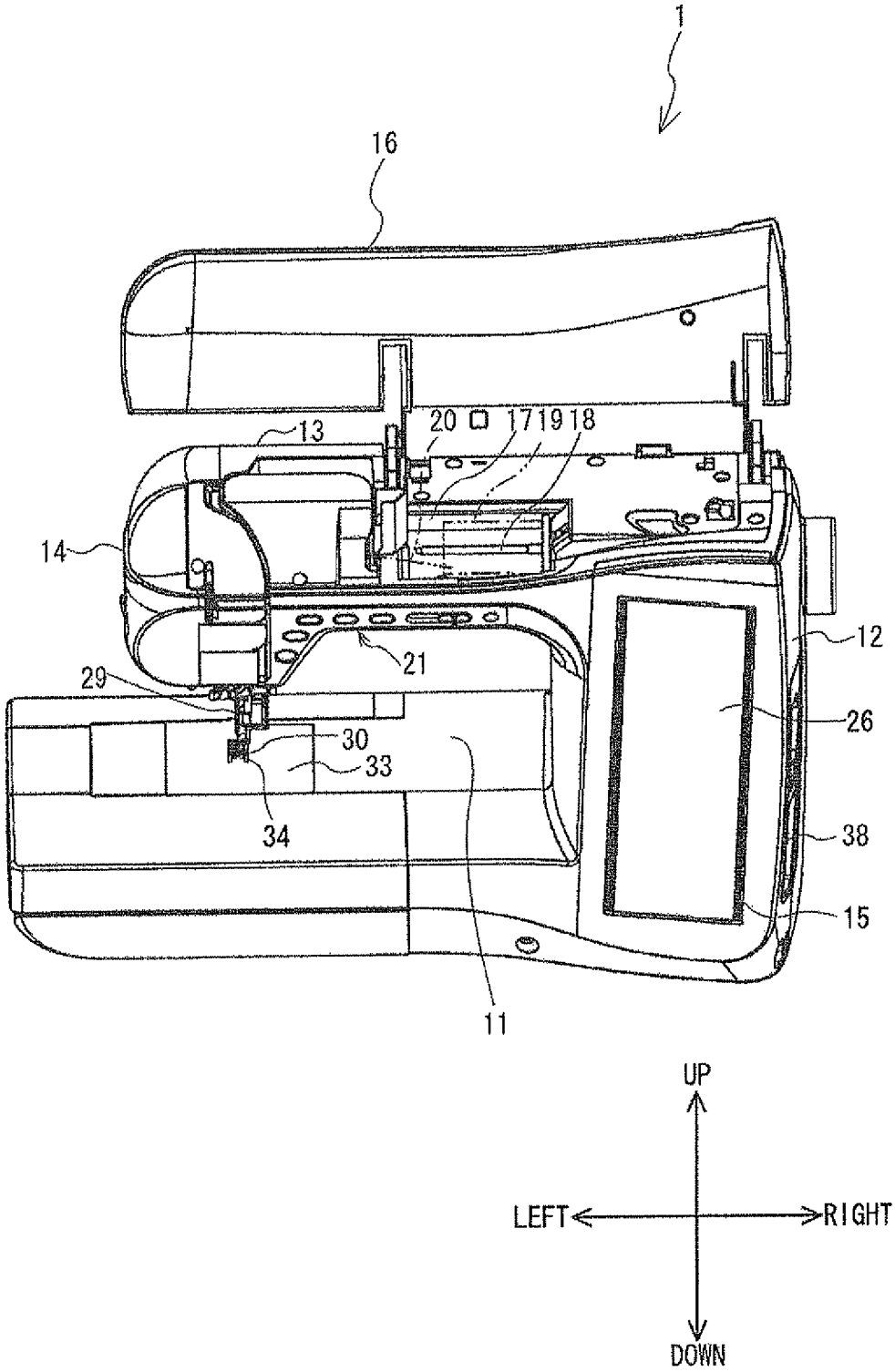
FIG. 1 is an oblique view from the front and above of a sewing machine with a cover that is opened.

Hereinafter, an embodiment of the present disclosure will be explained with reference to the drawings. The present embodiment is an example of a case in which the present disclosure is applied to a sewing machine that may form stitches in a work cloth by moving the work cloth in relation to a needle that moves up and down.

A physical configuration of a sewing machine 1 will be explained with reference to FIGS. 1 and 2. In the explanation that follows, the upward, the downward, the left, and the right directions respectively correspond to the upper side, the lower side, the left side, and the right side of the sewing machine 1. That is, a direction in which a pillar 12, which will be described later, extends is an up-down direction of the sewing machine 1. A direction in which a sewing machine bed 11 and an arm 13 extend is a left-right direction of the sewing machine 1. The face of the sewing machine 1 on which a switch cluster 21 is disposed is a front face.

Figure 2:
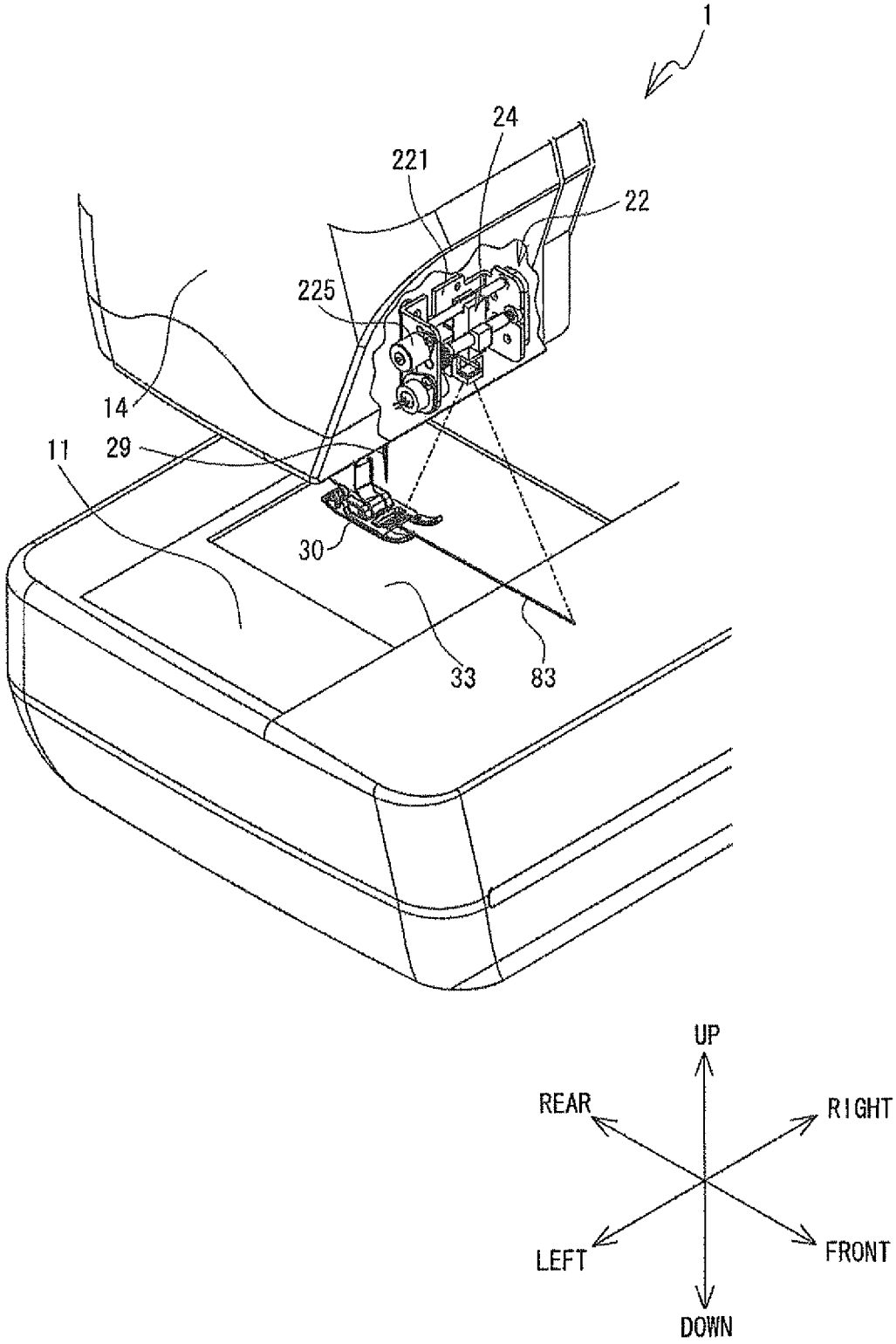
FIG. 2 is a figure that shows a configuration in the vicinity of a projection mechanism that is provided in a head.

As shown in FIG. 1, the sewing machine 1 includes the sewing machine bed 11, the pillar 12, the arm 13, and a head 14. The sewing machine bed 11 extends in the left-right direction and is the base of the sewing machine 1. The pillar 12 extends upward from the right end of the sewing machine bed 11. The arm 13 extends to the left from the upper end of the pillar 12, such that the arm 13 is opposite the sewing machine bed 11. The head 14 is a component that is connected to the left end of the arm 13. A needle plate 33 is provided in the top face of the sewing machine bed 11. A feed dog 34, a cloth feed mechanism (not shown in the drawings), a feed adjustment pulse motor 78 (refer to FIG. 8), and a shuttle mechanism (not shown in the drawings) are provided underneath the needle plate 33 (inside the sewing machine bed 11). The feed dog 34 may be driven by the cloth feed mechanism and may move a work cloth 85 (refer to FIG. 11) by a predetermined feed amount. The amount of the feed by the feed dog 34 may be adjusted by the feed adjustment pulse motor 78. A needle bar mechanism (not shown in the drawings), a swinging-and-releasing pulse motor 80 (refer to FIG. 8), and a thread take-up lever mechanism (not shown in the drawings) are provided inside the head 14. The needle bar mechanism may drive a needle bar (not shown in the drawings), to which a sewing needle 29 can be attached, in the up-down direction. The swinging-and-releasing pulse motor 80 may swing the needle bar to the left and to the right.

A liquid crystal display 15 that has a vertically rectangular shape is provided on the front face of the pillar 12. An image that includes various types of items, such as a command, an illustration, a setting value and a message etc., may be displayed on the liquid crystal display 7 based on image data.

A transparent touch panel 26 is provided on the front face of the liquid crystal display 15. A user can perform a pressing operation on the touch panel 26, using a finger or a touch pen. This operation is hereinafter referred to as a panel operation. The touch panel 26 may detect the position pressed by the figure or the touch pen, and the sewing machine 1 (more specifically, a CPU 61 that will be described later) may recognize the item that corresponds to the detected position. In this manner, the sewing machine 1 may recognize the selected item. The user can select a stitch type, command to be executed, make various types of settings for the selected stitch type, or the like, by performing a panel operation.

A connector 38, to which an external device such as a memory card or the like (not shown in the drawings) can be connected, is provided on the right side face of the pillar 12. The sewing machine 1 may receive from the external device, through the connector 38, stitch type data and various types of programs, which may then be stored in an EEPROM 64 and output from the sewing machine 1 to the outside.

The configuration of the arm 13 will be explained. A cover 16 that may open and close the top side of the arm 13 is attached to the arm 13. The cover 16 is provided such that the cover 16 extends in the left-right direction of the arm 13, and the cover 16 is axially supported by the upper rear edge of the arm 13 such that the cover 16 can be opened and closed by being rotated around that axis, which also extends in the left-right direction. A thread-containing portion 17 is provided inside the arm 13, around the center of the arm 13. The thread-containing portion 17 may contain a thread spool 19 that supplies thread to the sewing machine 1. A thread spool pin 18 is provided on an inner wall surface on the pillar 12 side of the thread-containing portion 17. The thread spool pin 18 projects toward the head 14, and the thread spool 19 may be mounted on the thread spool pin 18. The thread spool 19 may be mounted by inserting the thread spool pin 18 into an insertion hole that is provided in the thread spool 19. An upper thread 20 that extends from the thread spool 19, but is not shown in the drawings, may pass through a thread hook portion that includes a tensioner, a thread take-up spring, a thread take-up lever, and the like, and may be supplied to the sewing needle 29 that is attached to the needle bar. The tensioner and the thread take-up spring are configured to adjust the thread tension. The thread take-up lever may move reciprocally up and down and pull up on the upper thread 20.

A sewing machine drive shaft (not shown in the drawings) that extends in the left-right direction of the arm 13 is provided inside the arm 13. The sewing machine drive shaft may be rotationally driven by a sewing machine motor 79 (refer to FIG. 8). The needle bar mechanism and the thread take-up lever mechanism may be driven by the rotation of the sewing machine drive shaft. The switch cluster 21 is provided on the lower part of the front face of the arm 13. The switch cluster 21 includes a sewing start/stop switch, a reverse stitch switch, a needle up/down switch, a presser foot raise/lower switch, an automatic thread hook start switch, and the like.

In addition to the needle bar, the thread take-up lever, the tensioner, and the thread take-up spring, which have been described above, and in addition to a projection mechanism 22 (refer to FIG. 2), an automatic thread hook unit, an automatic threading mechanism, and the like are provided in the head 14, although they are not shown in the drawings. A presser bar (not shown in the drawings) is provided to the rear of the needle bar and is supported by a sewing machine frame such that the presser bar can move up and down. A presser foot 30 that may press down on the work cloth is affixed to the lower end of the presser bar.

Figure 3:
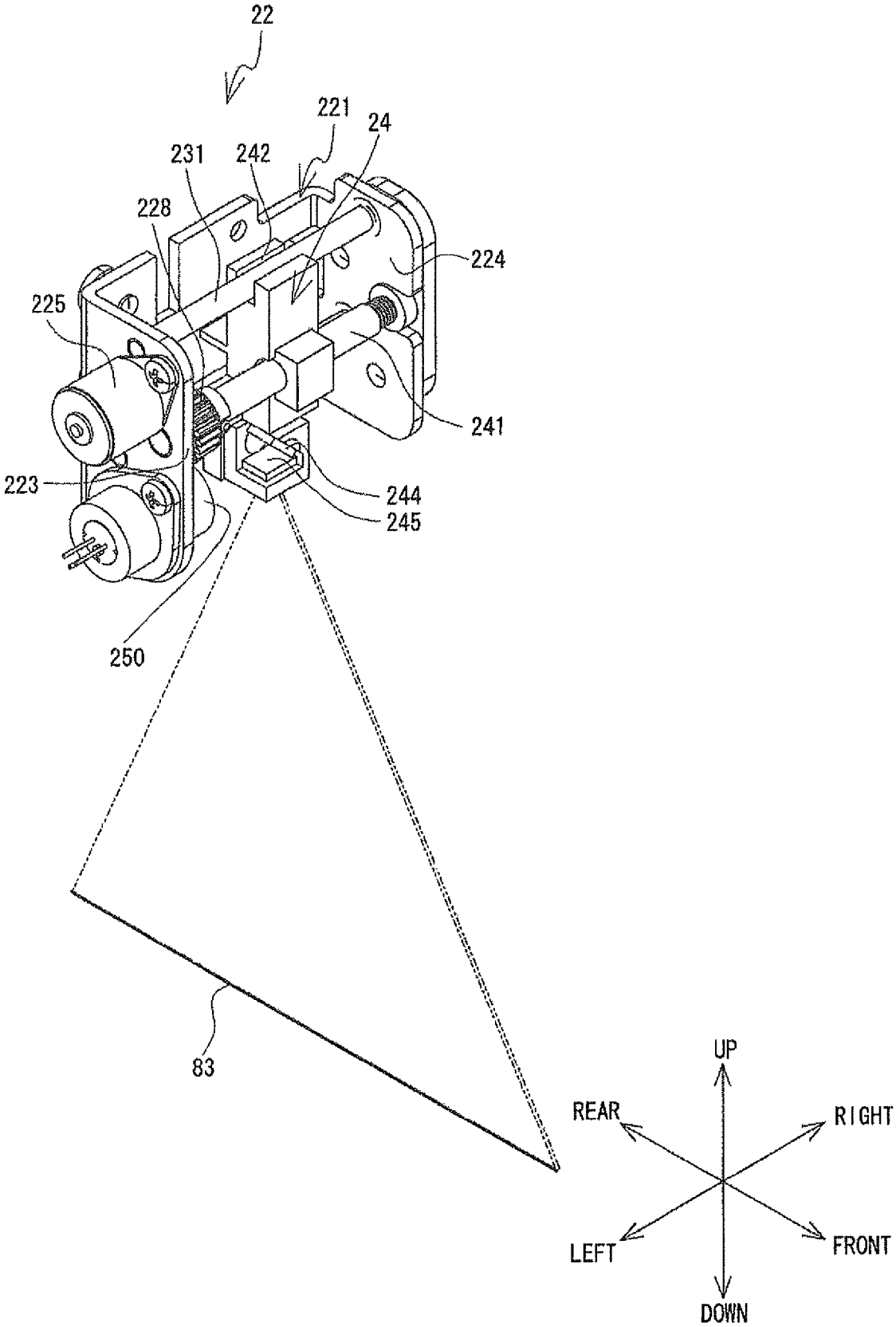
FIG. 3 is an oblique view of the projection mechanism.
Figure 4:
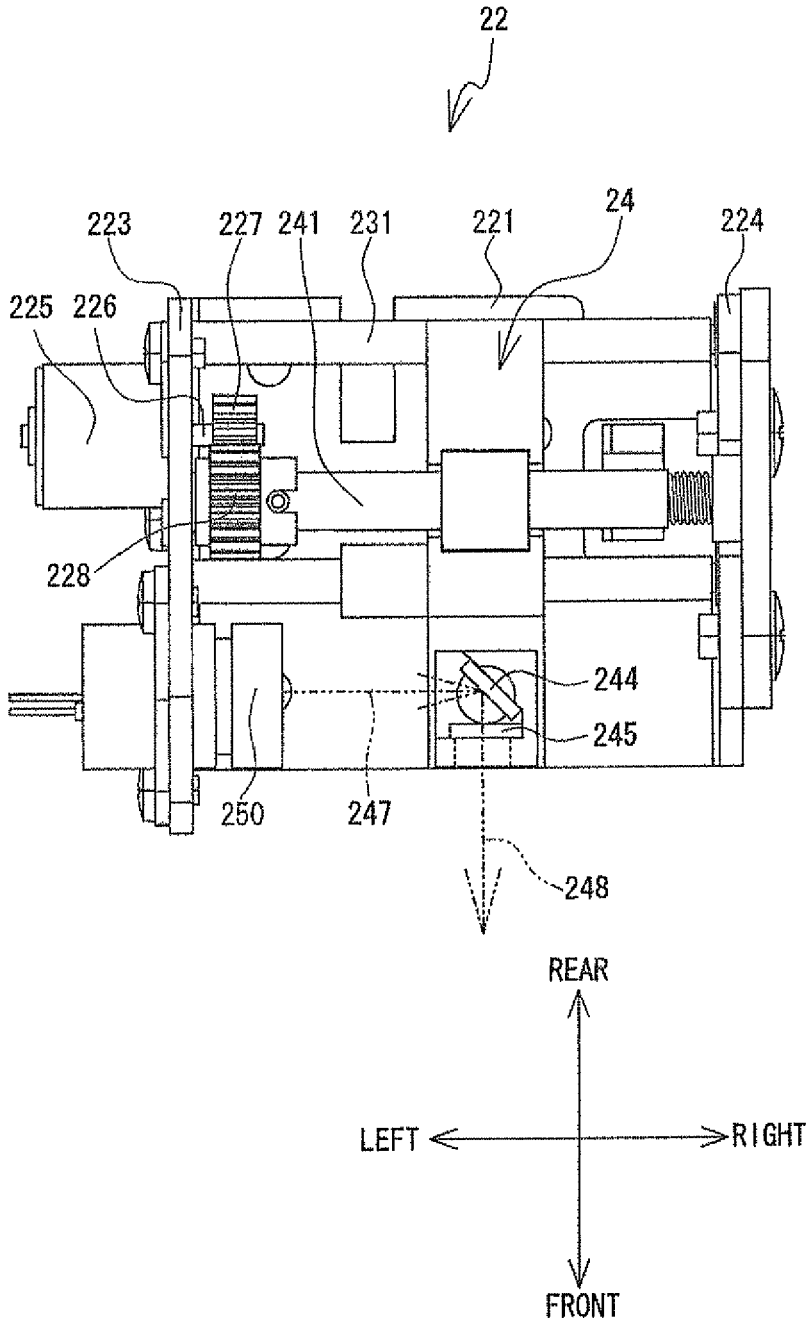
FIG. 4 is a front view of the projection mechanism.

The projection mechanism 22 will be explained with reference to FIGS. 2 to 4. The projection mechanism 22 is configured to project a mark 83 in the form of a beam of light that may serve as a reference for the positioning of the work cloth 85 and the like. The projection mechanism 22 may be contained within the head 14 and may be positioned obliquely above and to the front of the needle bar and the presser foot 30. As shown in FIGS. 2 to 4, the projection mechanism 22 includes a plate-shaped supporting member 221. The supporting member 221 is configured to support various members that make up the projection mechanism 22. The projection mechanism 22 may be affixed to the head 14 by using a screw or the like (not shown in the drawings) to affix the supporting member 221 to the head 14. As shown in FIGS. 3 and 4, the left and right ends of the supporting member 221 are bent toward the front, forming a wall 223 on the left side and a wall 224 on the right side. A projection position moving motor 225 may be provided on the left side of the upper portion of the wall 223. A rotating shaft 226 of the projection position moving motor 225 projects from the right side of the wall 223, and a gear 227 may be affixed to the end of the rotating shaft 226 (refer to FIG. 4).

The gear 227 may mesh with a gear 228 that is provided obliquely below and to the front of the gear 227. The gear 228 may be affixed to the left end of a lead screw 241. The lead screw 241 extends in the left-right direction between the wall 223 and the wall 224. The left and right ends of the lead screw 241 may be supported by the wall 223 and the wall 224 such that the lead screw 241 can rotate, but cannot move in the axial direction. A threaded portion is formed on the outer circumferential face of the lead screw 241, although the threaded portion is not shown in detail in the drawings. When the rotating shaft 226 of the projection position moving motor 225 (refer to FIG. 4) rotates, the lead screw 241 is rotated through the gear 227 and the gear 228.

A movable carriage 24 is a block-shaped member that extends in the up-down direction. A threaded hole that extends in the left-right direction is formed approximately in the center of the up-down direction of the movable carriage 24, although the threaded hole is not shown in detail in the drawings. The threaded portion of the lead screw 241 may be screwed into the threaded hole. Therefore, when the lead screw 241 rotates in the clockwise direction as seen from the left side, the movable carriage 24 moves toward the left. Conversely, when the lead screw 241 rotates in the counter-clockwise direction as seen from the left side, the movable carriage 24 moves toward the right. A supporting shaft 231 that is long in the left-right direction may be affixed between the upper portions of the wall 223 and the wall 224. A recessed portion 242 (refer to FIG. 3) is provided in the top side of the movable carriage 24, in the center in the front-rear direction. The recessed portion 242 is a portion that is recessed downward across the movable carriage 24 in the left-right direction. The supporting shaft 231 may be fitted into the recessed portion 242 such that the supporting shaft 231 can slide. Therefore, even if the lead screw 241 rotates, the rotation of the movable carriage 24 is locked in the direction in which the lead screw 241 rotates, so the movable carriage 24 moves in the left-right direction while maintaining its orientation.

A reflecting mirror 244 and a lens 245 are provided in the bottom end portion of the movable carriage 24. The reflecting mirror 244 may be installed such that its reflective surface faces obliquely downward and to the left. A laser emitter 250 may be provided to the left of the reflecting mirror 244. The laser emitter 250 may be supported by the wall 223. The laser emitter 250 is configured to project red light to the right, toward the reflecting mirror 244 (refer to an arrow 247 in FIG. 4).

Figure 11:
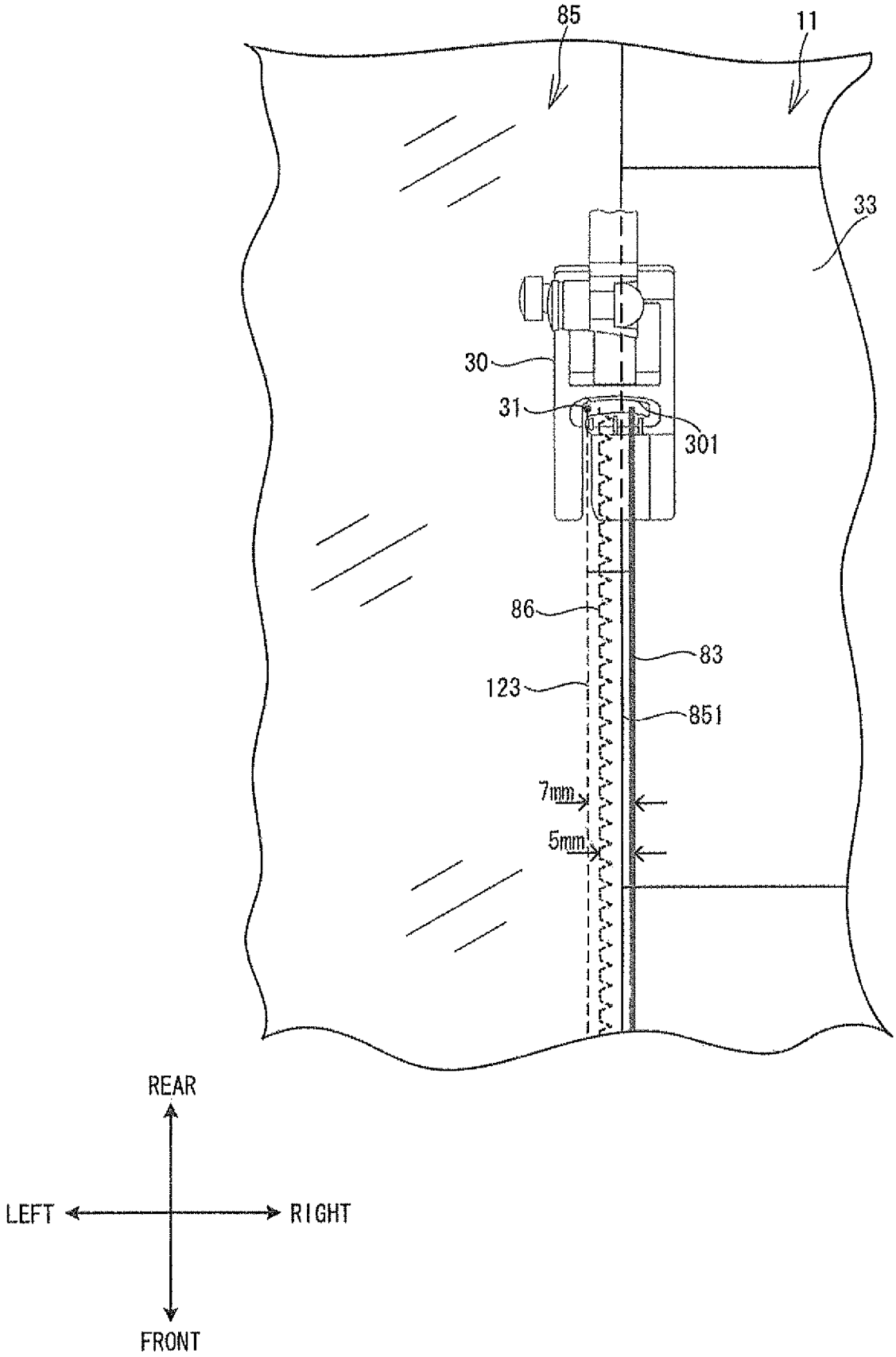
FIG. 11 is a figure that shows a state in which a mark is projected onto a sewing machine bed to the right of a work cloth.

The lens 245 may be a lenticular lens and is provided below the reflecting mirror 244. The beam that is projected to the right by the laser emitter 250 may be reflected downward by the reflecting mirror 244 (refer to an arrow 248 in FIG. 4). The downward-reflected beam may be refracted downward by the lens 245 such that the downward-reflected beam becomes wider in the front-rear direction. The refracted beam may move downward as the refracted beam becomes wider in the front-rear direction (refer to FIG. 3). In a case where the beam is projected onto at least one of the top face of the sewing machine bed 11 that is positioned below the projection mechanism 22 and the work cloth 85 that is placed on top of the top face of the sewing machine bed 11 (refer to FIG. 11), the beam may form the mark 83, which is long in the front-rear direction (refer to FIGS. 2, 3, 11, and 13). That is, the projection mechanism 22 is configured to project the mark 83, which is long in the front-rear direction, onto at least one of the top face of the sewing machine bed 11, which includes the needle plate 33, and the work cloth 85 that is placed on top of the top face of the sewing machine bed 11. As shown in FIG. 11, the rear end position of the projected mark 83 in the front-rear direction may be set such that the rear end position of the projected mark 83 is positioned at a hole 301, which the sewing needle 29 on the presser foot 30 may pass through. Note that the rear end position of the projected mark 83 in the front-rear direction and the length of the mark 83 in the front-rear direction are not limited to this example and may also be set as the user desires.

An operation that moves the projection position for the mark 83 in the left-right direction will be explained. The moving of the projection position for the mark 83 may be performed by the controlling of the rotation of the projection position moving motor 225 by the CPU 61 (refer to FIG. 8) of the sewing machine 1. As described previously, when the projection position moving motor 225 rotates, the movable carriage 24 moves in the left-right direction. The moving of the movable carriage 24 in the left-right direction may cause the reflecting mirror 244 and the lens 245 to move in the left-right direction. Thus the position of the reflecting mirror 244, which may reflect downward the beam that is projected by the laser emitter 250, may be moved in the left-right direction. In conjunction with this, the position of the mark 83 in the left-right direction also may move.

Figure 5:
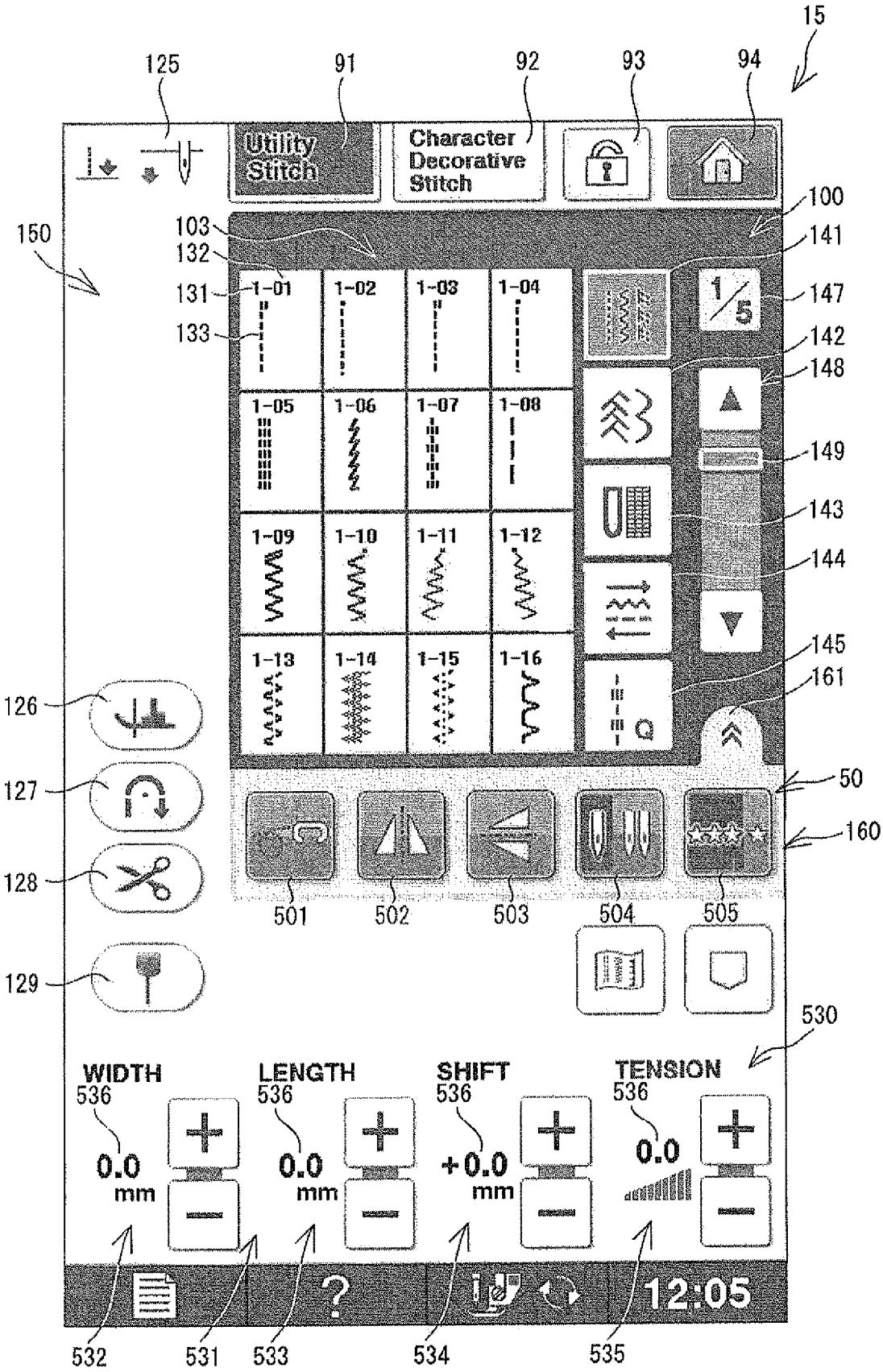
FIG. 5 is an example of an image that is displayed on a liquid crystal display.
Figure 6:
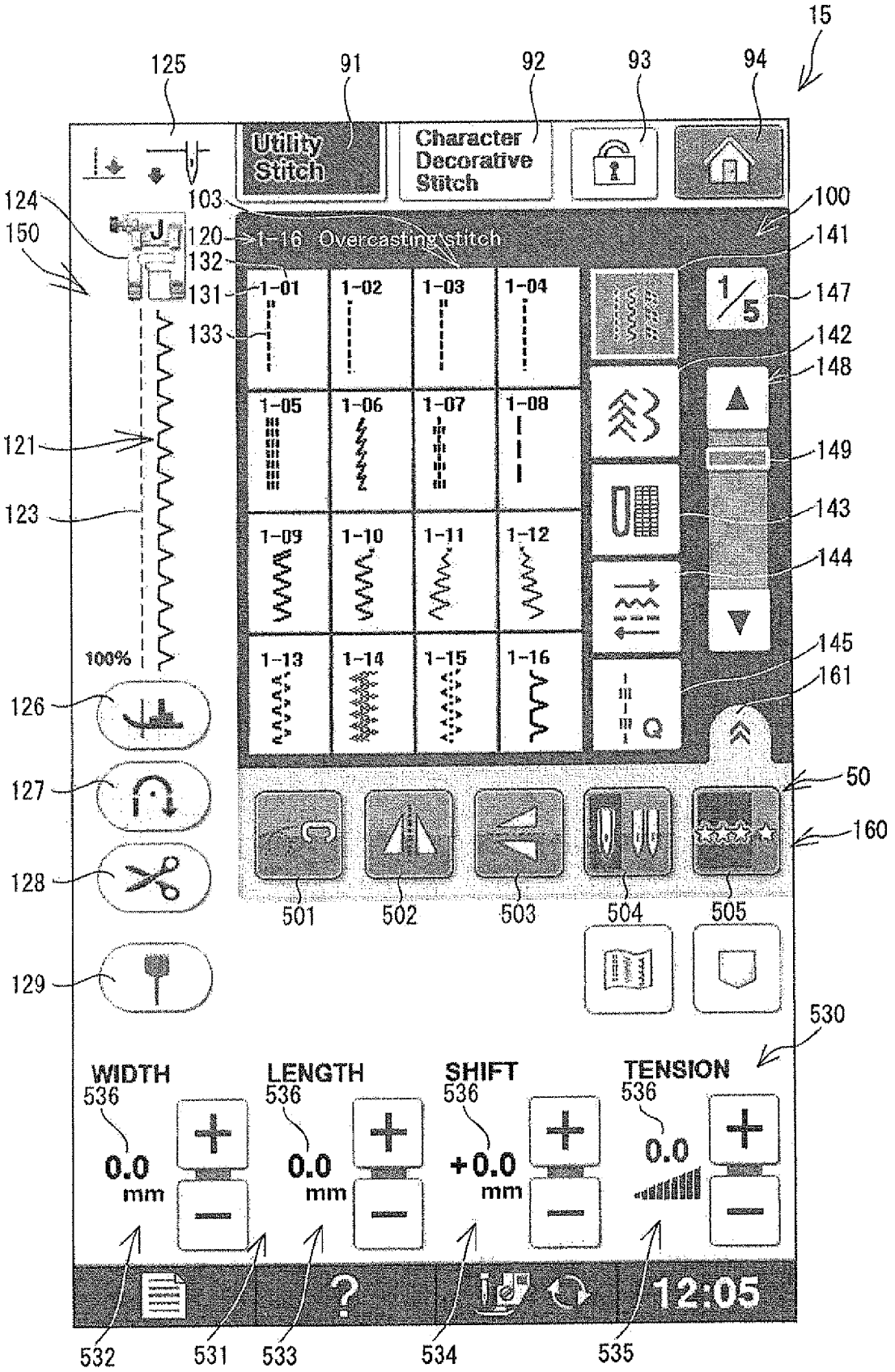
FIG. 6 is an example of an image that is displayed on the liquid crystal display in a case where a stitch type selection key is selected by a panel operation.
Figure 7:
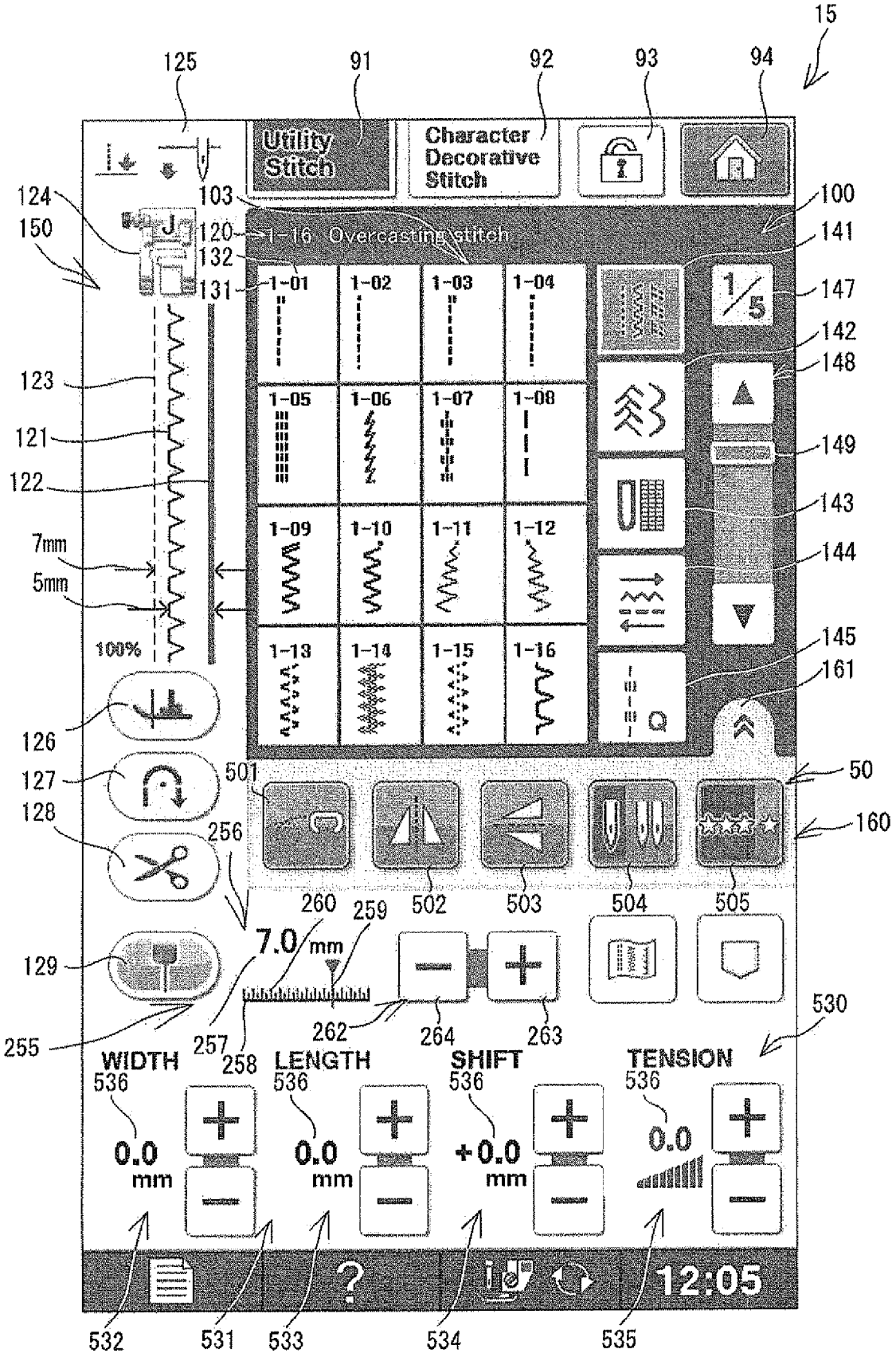
FIG. 7 is an example of an image that is displayed on the liquid crystal display in a case where a mark key is selected by a panel operation.

Images that may be displayed on the liquid crystal display 15 will be explained with reference to FIGS. 5 to 7. As shown in FIGS. 5 to 7, a utility stitch key 91, a character decorative stitch key 92, a screen lock key 93, and a home key 94 may be displayed from left to right along the top of the liquid crystal display 15. In a case where the utility stitch key 91 is selected by a panel operation, stitch type selection keys 103 may be displayed in a first display area 100 (described later). The stitch type selection keys 103 may be used by the user for selecting utility stitches that to be formed by the sewing machine 1. The utility stitches are stitch types that are commonly used in dressmaking, such as a straight stitch, a zigzag stitch, a buttonhole stitch, a quilt stitch, and the like, for example. FIGS. 5 to 7 show states in which the utility stitch key 91 is selected by a panel operation and the stitch type selection keys 103 for the utility stitches are displayed.

In a case where the character decorative stitch key 92 is selected by a panel operation, the stitch type selection keys 103 may be displayed in the first display area 100. The stitch type selection keys 103 that are displayed in a case where the character decorative stitch key 92 has been selected may be used by the user for selecting character decorative stitches that to be formed by the sewing machine 1. The character decorative stitches include, for example, stitch types for hiragana characters, katakana characters, alphabetic characters, and the like, as well as stitch types for ornamentation. In a case where the screen lock key 93 is selected by a panel operation, the CPU 61 may be locked, such that processing is not performed even if the touch panel 26 is touched. In a case where the home key 94 is selected by a panel operation, a home screen may be displayed. The home screen is a screen that is initially displayed when the power supply to the sewing machine 1 is turned on.

The first display area 100 may be displayed below the utility stitch key 91, the character decorative stitch key 92, the screen lock key 93, and the home key 94. As shown in FIGS. 5 to 7, the plurality of the stitch type selection keys 103, category selection keys 141 to 145, a category number display 147, and a position display 148 may be displayed in the first display area 100. The stitch type selection keys 103 may be classified according to the uses of the corresponding stitch types into five categories that may be identified by the category numbers 1 to 5. The stitch type selection keys 103 may be displayed in the first display area 100 one category at a time. In the present embodiment, the category number 1 indicates a group of stitch types that are straight stitches and zigzag stitches. The category number 2 indicates a group of stitch types that are decorative stitch types. The category number 3 indicates a group of stitch types that are buttonhole stitches. The category number 4 indicates a group of stitch types that are transverse stitch types, for which the stitches are formed in the left-right direction by feeding the work cloth to one of the left and the right. The category number 5 indicates a group of stitch types that are quilt stitch types.

Some (sixteen in FIGS. 5 to 7) of the plurality of the stitch type selection keys 103 that are classified by the category number 1 are displayed in the first display area 100 that is shown in FIGS. 5 to 7. A category number 131, a sub-category number 132, and a stitch type pattern 133 may be displayed on each of the stitch type selection keys 103. The category number 131 indicates the number of the category into which the utility stitch is classified. The sub-category number 132 is a number that is assigned to each of the stitch types within the category. The stitch type pattern 133 may show a simplified version of the shape of the stitch type.

Data for the stitch type that corresponds to the stitch type selection key 103 that has been selected by the user from among the stitch type selection keys 103 that may be displayed in the first display area 100 (data that may be stored in a stitch type data table that will be described later) may be read from the EEPROM 64 and stored in a RAM 63. The category number, the sub-category number, and a stitch type name for the selected stitch type may be displayed in a selected stitch type display field 120 above the stitch type selection keys 103 (refer to FIG. 6). In FIG. 6, the stitch type selection key 103 for the category number 1 and the sub-category number 16 has been selected. "1-16 Overcasting stitch" is displayed in the selected stitch type display field 120 to show the category number, the sub-category number, and the stitch type name that correspond to the selected stitch type selection key 103.

A selected stitch type display 121 that corresponds to the selected utility stitch may be displayed in a selected stitch type display area 150 (refer to FIG. 6). The selected stitch type display area 150 is provided to the left of the first display area 100. Therefore, the user may easily recognize visually what kind of stitches to be formed in a case where the selected stitch type is sewn. Other displays that may be displayed in the selected stitch type display area 150 will be described later.

The five category selection keys 141 to 145 may be displayed in a vertical array to the right of the plurality of the stitch type selection keys 103 in the first display area 100. The category selection keys 141 to 145 may be used for selecting the category numbers 1 to 5. In a case where any one of the categories is selected by a panel operation, the stitch type selection keys 103 for the stitch types that are included in the selected category may be displayed in the first display area 100.

The category number display 147 and the position display 148 may be displayed to the right of the category selection keys 141 to 145. The category number display 147 indicates the selected category. In FIGS. 5 to 7, "1/5" is displayed, indicating that of the total of the five categories, the stitch type selection keys 103 that are classified into the category number 1 are being displayed in the first display area 100. The position display 148 indicates the position, among the plurality of the stitch type selection keys 103, of the stitch type selection keys 103 that are displayed in the first display area 100. By performing a panel operation, the user can move a cursor 149 up and down within the position display 148. By moving the cursor 149 up and down, the user can cause the liquid crystal display 15 to display the stitch type selection keys 103 that are not displayed in FIGS. 5 to 7.

Below the first display area 100, a second display area 160 is provided that is adjacent to the first display area 100. A plurality of function keys 50 may be displayed in the second display area 160. The function keys 50 may be used for making specified settings for the stitch types. Among the function keys 50, function keys 501 to 505 may be displayed in a first row. A tab 161 is provided in the upper right portion of the second display area 160, and in a case where the user selects the tab 161 by a panel operation, a second row of function keys (not shown in the drawings) that is not displayed in FIGS. 5 to 7 may be displayed on the liquid crystal display 15.

Of the plurality of the function keys 50, the function key 501 is a free motion mode key. The function key 501 may be used for making a setting for the sewing machine 1 such that the feed dog 34 does not touch the work cloth 85 and the user can move the work cloth 85 freely. The function key 502 is a left-right inversion key. The function key 502 may be used for making a left-right inversion of the stitch type. The function key 503 is a top-bottom inversion key. The function key 503 may be used for making a top-bottom inversion of the stitch type. The function key 504 is a two needles key. The function key 504 may be used for switching settings between a case in which sewing to be performed with one needle and a case in which sewing to be performed with two needles. The function key 505 is a continuous sewing key. The function key 505 may be used for switching between a case in which a plurality of stitch types are sewn continuously and a case in which the sewing stops after each individual stitch type is sewn.

The previously described selected stitch type display area 150 will be explained in greater detail. As shown in FIG. 6, a presser foot code 124 may be displayed above the selected stitch type display 121 in the selected stitch type display area 150. The presser foot code 124 indicates the presser foot 30 (refer to FIG. 1) that is to be mounted, in a case where the sewing machine 1 sew the stitch type that has been selected by using one of the stitch type selection keys 103. The user can mount on the sewing machine 1 the presser foot 30 that is appropriate for sewing the selected stitch type by referencing the presser foot code 124. A needle setting state 125 may be displayed above the presser foot code 124 and indicates the position of the needle when the operation of the sewing machine 1 stops. In the needle setting state 125 in FIGS. 5 to 7, an arrow points downward, indicating a setting in which the sewing needle 29 to be stopped in a state of having pierced the work cloth 85 when the operation stops.

As shown in FIG. 7, a red mark display 122 may be displayed along with the selected stitch type display 121 in the selected stitch type display area 150. A more detailed description will be provided later, but the mark display 122 and the selected stitch type display 121 may be displayed on the liquid crystal display 15 in a positional relationship that is the same as the positional relationship between a position where a planned stitch type 86 (refer to FIG. 11) to be sewn and the position in a case where the mark 83 is projected onto at least one of the top face of the sewing machine bed 11 and the work cloth 85 that is placed on top of the top face of the sewing machine bed 11 (refer to FIG. 11). The planned stitch type 86 is the stitch type that is selected by the user, by using one of the stitch type selection keys 103 and is the stitch type for which sewing is planned.

A pivot key 126, an automatic reinforcement stitch key 127, an automatic thread cut key 128, and a mark key 129 may be displayed in a vertical array below the selected stitch type display 121. The pivot key 126 may be used for making a pivot setting. In a case where a pivot setting is made and the sewing machine 1 accepts a command to stop sewing, the sewing machine 1 stops sewing with the sewing needle 29 in a lowered state. Then the presser foot 30 may automatically rise. The user can rotate the work cloth 85 using the sewing needle 29 as a pivot point. The automatic reinforcement stitch key 127 may be used for setting an operation that sews a reinforcement stitch automatically when sewing starts and when sewing is completed. The automatic thread cut key 128 may be used for making a setting such that the upper thread and a lower thread to be cut automatically when sewing is completed.

The mark key 129 may be used for switching between a case in which the mark 83 to be projected from the projection mechanism 22 and a case in which the mark 83 is not to be projected. In a state in which the mark 83 is not being projected, in a case where the mark key 129 is selected by a panel operation, the mark 83 is to be projected (Step S45 in FIG. 10). At this time, the mark display 122 is to be displayed on the liquid crystal display 15 (Step S43 in FIG. 10). In a state in which the mark 83 is being projected, in a case where the mark key 129 is selected by a panel operation, the projecting of the mark 83 is to be stopped (Step S47 in FIG. 10). At this time, the mark display 122 that was being displayed on the liquid crystal display 15 is to be hidden (Step S46 in FIG. 10). In a case where the mark key 129 is selected by a panel operation and the mark 83 is projected, a mark-related area 255 may be displayed, as shown in FIG. 7. The mark-related area 255 is an area in which the mark key 129, a distance display 256, and projection position adjustment keys 262 may be displayed.

The distance display 256 may be displayed to the right of the mark key 129 in the mark-related area 255. The projection position adjustment keys 262 may be displayed to the right of the distance display 256. The distance display 256 is a display that indicates the distance between a reference position 123 (refer to FIG. 11) and the mark 83 that is projected from the projection mechanism 22 (refer to FIG. 11). The reference position 123 is a predetermined position on one of the top face of the sewing machine bed 11 and the work cloth 85 that is placed on top of the top face of the sewing machine bed 11. In the present embodiment, the reference position 123 is a straight line, on one of the top face of the sewing machine bed 11 and the work cloth 85 that is placed on top of the top face of the sewing machine bed 11, that extends toward the front from a needle drop point 31 of the sewing needle 29 (refer to FIG. 11) when the needle bar, which can swing to the left and to the right, has moved to its farthest left position (refer to FIG. 11). In FIG. 7, for the purpose of explanation, a position that is equivalent to the reference position 123 is shown as a virtual line (a broken line) in the selected stitch type display area 150. However, the reference position 123 may not be actually displayed in the selected stitch type display area 150. The positional relationship between the reference position 123 and the mark display 122 that are shown in the selected stitch type display area 150 is the same positional relationship as the positional relationship between the projected mark 83 and the predetermined reference position 123 on one of the top face of the sewing machine bed 11 and the work cloth 85 that is placed on top of the top face of the sewing machine bed 11 (refer to FIG. 11). Note that the reference position 123 may be displayed in the selected stitch type display area 150.

The distance display 256 includes a numerical value display 257 and a scale display 258. The numerical value display 257 indicates the distance between the reference position 123 and the projection position for the mark 83 in the form of a numerical value, and in FIG. 7, "7.0 mm" is displayed. The scale display 258 is a display of a scale that indicates the projection position for the mark 83. A projection position display 259 that is displayed on the scale display 258 indicates the current projection position. On the scale display 258, the position of a scale mark 260 may serve as a reference position. In the present embodiment, the scale mark 260 indicates zero millimeters on the scale display 258. On the scale display 258, the rightward direction is the plus (+) direction, and the leftward direction is the minus (−) direction. The projection mechanism 22 according to the present embodiment is configured to project the mark 83 to a position that is as much as three millimeters to the left of the reference position. Further, the projection mechanism 22 is configured to project the mark 83 to a position that is as much as eleven millimeters to the right of the reference position. That is, the projection mechanism 22 may vary the projection position for the mark 83 within the range of −3 millimeters to +11 millimeters in the left-right direction in relation to the reference position. Accordingly, the scale marks on the scale display 258 may be displayed for the range from −3 millimeters to +11 millimeters.

The projection position adjustment keys 262 include a plus key 263 and a minus key 264. The user can use the plus key 263 for moving the projection position for the mark 83 0.5 millimeters in the plus direction. The user can use the minus key 264 for moving the projection position for the mark 83 0.5 millimeters in the minus direction.

An item display area 530 is provided below the mark-related area 255. Stitch adjustment keys 531, shift keys 534, and tension keys 535 may be displayed in the item display area 530. The stitch adjustment keys 531 include width adjustment keys 532 and length adjustment keys 533. The user can use the width adjustment keys 532 for adjusting the zigzag swing width for the stitch type that has been selected by one of the stitch type selection keys 103. The user can use the length adjustment keys 533 for adjusting the stitch length for the selected stitch type. The user can use the shift keys 534 for moving the stitch position to the left and to the right. The user can use the tension keys 535 for adjusting the thread tension. By operating the individual keys 532 to 535 that may be displayed in the item display area 530, the user can adjust the setting values as desired by increasing and decreasing the individual setting values. The setting values may be displayed in setting value displays 536 to the left of the corresponding keys 532 to 535.

The upper limit value and the lower limit value for the swing width, and the upper limit value and the lower limit value for the stitch length, may be set in the range of 0.0 to 7.0 millimeters and the range of 0.0 to 5.0 millimeters, respectively, in accordance with the stitch type that is selected, and may be stored in one of a ROM 62 and the EEPROM 64. The upper limit values and the lower limit values that have been stored for the swing width and the stitch length may be read when various types of processing are performed that involve the swing width and the stitch length, and they may be stored in the RAM 63 in a state in which they can be adjusted. Therefore, the sewing machine 1 can adjust the swing width and the stitch length for the selected stitch type easily and precisely according to the user's preferences and can sew the stitch type using the desired stitches. The setting value for the thread tension may be ordinarily set to an optimum thread tension that is determined for each stitch type, and the thread tension can be adjusted in a range of 0.0 to 9.0.

Figure 8:
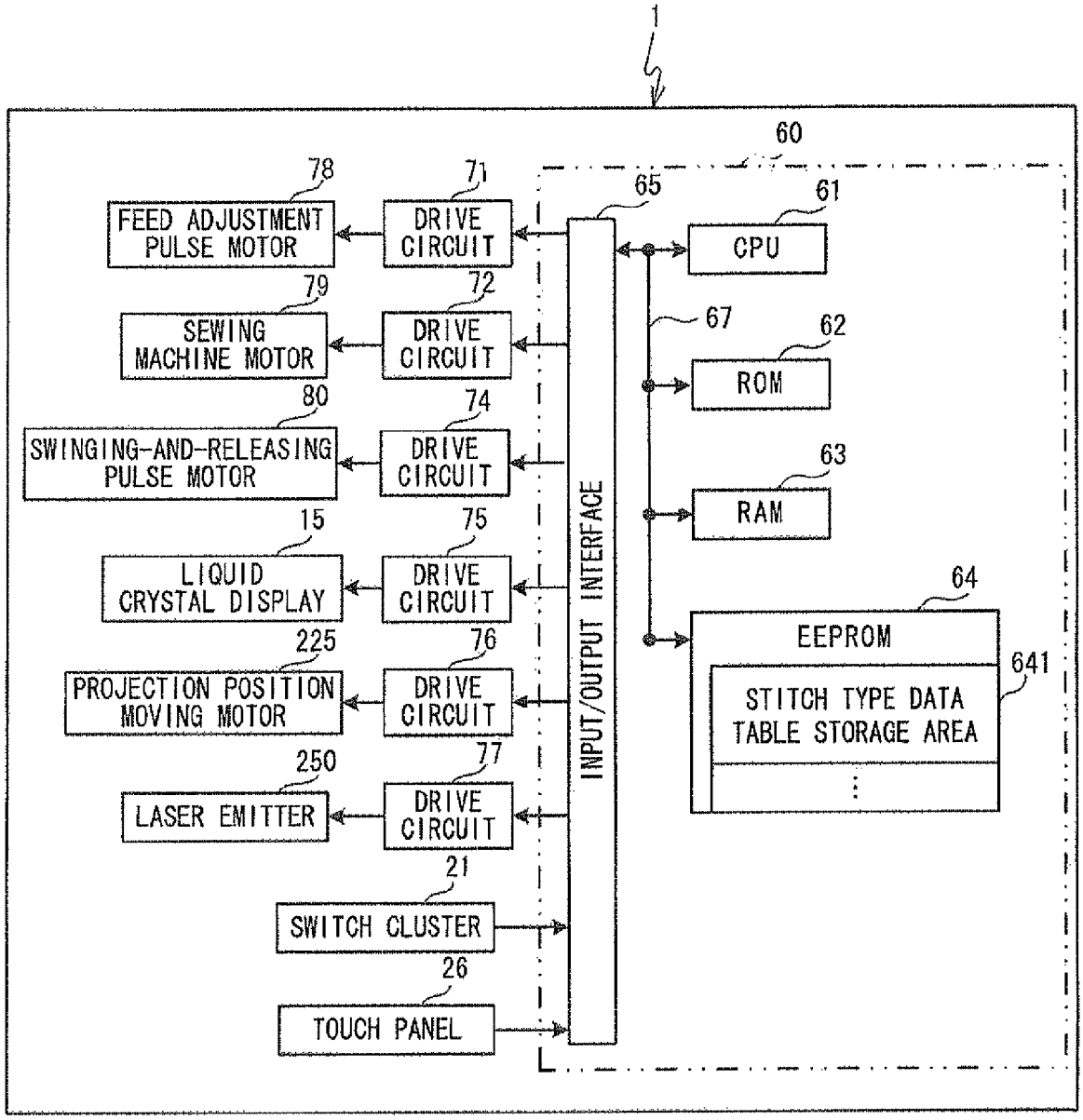
FIG. 8 is a block diagram that shows an electrical configuration of the sewing machine.

An electrical configuration of the sewing machine 1 will be explained with reference to FIG. 8. As shown in FIG. 8, a control portion 60 of the sewing machine 1 includes the CPU 61, the ROM 62, the RAM 63, the EEPROM 64, and an input/output interface 65, all of which are connected to one another by a bus 67. Programs, data, and the like for the CPU 61 to perform processing may be stored in the ROM 62. The EEPROM 64 includes a stitch type data table storage area 641. A stitch type data table that will be described later may be stored in the stitch type data table storage area 641. Upper limit values, lower limit values, optimum values, and set values for the stitch length, the thread tension, and the like for each stitch type may also be stored in the EEPROM 64. Various other types of data may also be stored in the EEPROM 64. Various types of temporary data may be stored in the RAM 63.

The switch cluster 21, the touch panel 26, and drive circuits 71, 72, 74, 75, 76, 77 are electrically connected to the input/output interface 65. The drive circuit 71 may drive the feed adjustment pulse motor 78. The drive circuit 72 may drive the sewing machine motor 79. The drive circuit 74 may drive the swinging-and-releasing pulse motor 80. The drive circuit 75 may drive the liquid crystal display 15. The drive circuit 76 may drive the projection position moving motor 225 (refer to FIGS. 3 and 8). By controlling the rotation direction and the revolution speed of the projection position moving motor 225 through the drive circuit 76, the CPU 61 can move the mark 83 that is projected by the projection mechanism 22 to the left and to the right. The drive circuit 77 may drive the laser emitter 250. By using the drive circuit 77 to cause light to be emitted from the laser emitter 250, the CPU 61 can cause the projection mechanism 22 to project the mark 83.

The stitch type data table will be explained. The stitch type data table may be stored in the stitch type data table storage area 641 of the EEPROM 64. The category number, the sub-category number, the stitch type name, stitch type pattern data, sewing data, and a presser foot type are stored in the stitch type data table for each of the plurality of the stitch types.

The stitch type with the category number 1 and the sub-category number 16 will be explained as an example. The stitch type name that is associated with the category number-sub-category number 1-16 is "Overcasting stitch". The stitch type pattern data that is referred to as "1-16 stitch type pattern" is data for displaying the shape of the stitch type "Overcasting stitch" for the category number-sub-category number 1-16 as the selected stitch type display 121 (refer to FIG. 6) on the liquid crystal display 15. The sewing data that is referred to as "1-16 sewing data" is data that prescribe the amount of swinging of the needle bar (the needle drop point) and the amount of feed by the feed dog 34 in order for the stitch type "Overcasting stitch" to be sewn. In a case where the sewing is performed by the sewing machine 1 under the control of the CPU 61, the sewing may be performed in accordance with the sewing data. The presser foot type "J presser foot" indicates the presser foot 30 that is to be used in a case where the stitch type referred to as "Overcasting stitch" is sewn. The presser foot code 124 (refer to FIG. 6) may be displayed on the liquid crystal display 15 based on the presser foot type. Other types of the presser foot 30 include an N presser foot, an A presser foot, a Q presser foot, and the like, although a detailed explanation will be omitted. The N presser foot is a presser foot that is to be used in a case where the sewing machine 1 sews decorative stitch types and transverse stitch types. The A presser foot is a presser foot that is to be used in a case where the sewing machine 1 sews buttonholes. The Q presser foot is a presser foot that is to be used in a case where the sewing machine 1 sews quilt stitches.

Figure 9:
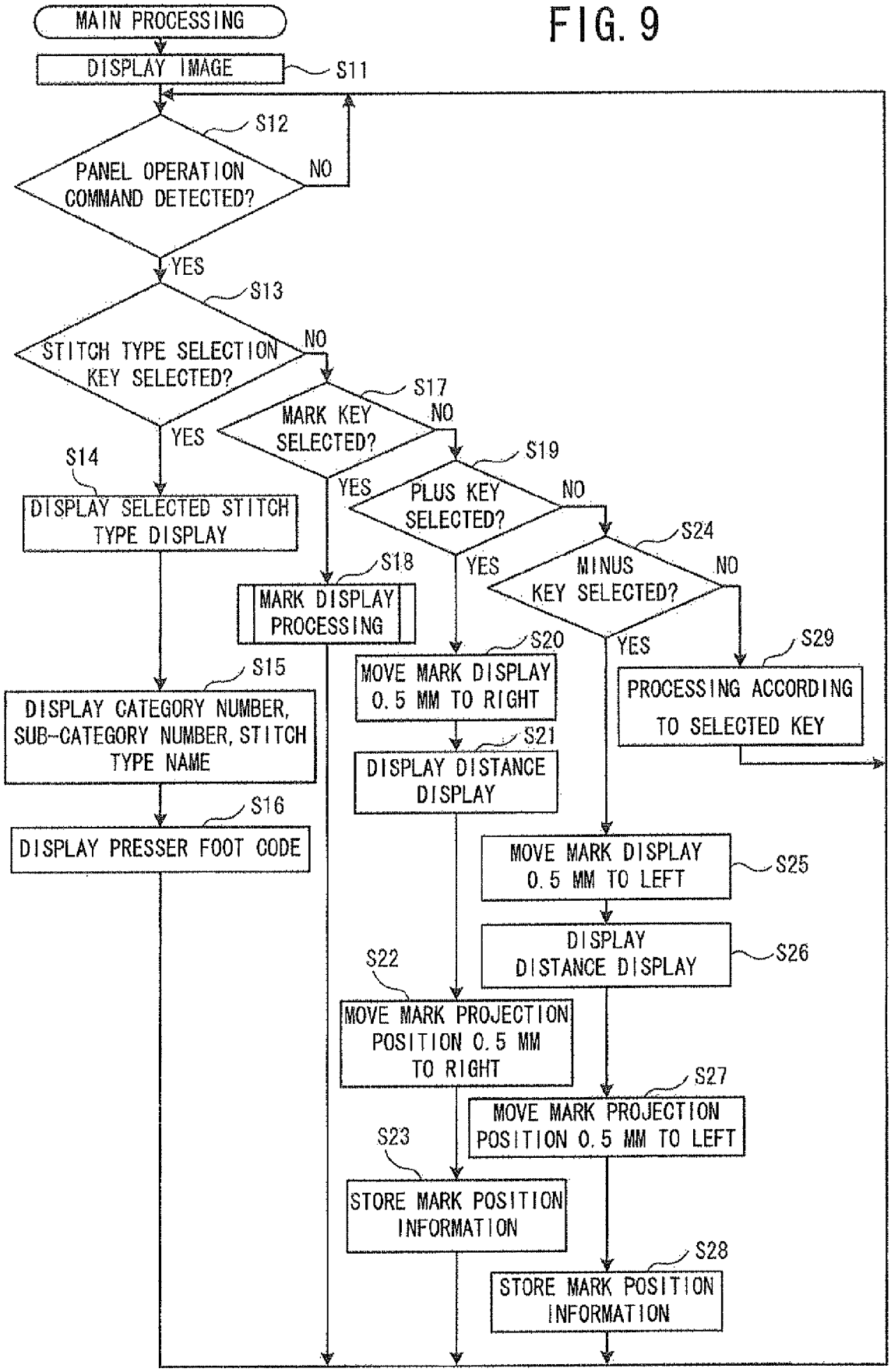
FIG. 9 is a flowchart of main processing.

Main processing will be explained with reference to the flowchart in FIG. 9. The main processing is performed by the CPU 61 of the sewing machine 1. The main processing is started when the power supply to the sewing machine 1 is turned on. As shown in FIG. 9, in the main processing, first, an image is displayed on the liquid crystal display 15 (Step S11). The image that is displayed at Step S11 may be, for example, an image that was being displayed on the liquid crystal display 15 immediately before the power supply to the sewing machine 1 was turned off. Information that is for displaying the image may be stored in the EEPROM 64. At Step S11, information that is for displaying the image and that is stored in the EEPROM 64 is read and stored in the RAM 63, and the image is displayed. In the present embodiment, the image that is shown in FIG. 5 is displayed on the liquid crystal display 15. FIG. 5 shows the image in a state in which the stitch type has not been selected.

The CPU 61 determines whether a command issued by a panel operation has been detected (Step S12). In a case where the CPU 61 has not detected a command issued by a panel operation (NO at Step S12), the CPU 61 waits for as long as a command issued by a panel operation is not detected. In a case where a command issued by a panel operation has been detected (YES at Step S12), it is determined whether one of the stitch type selection keys 103 was selected by the panel operation that was detected at Step S12 (Step S13). In a case where one of the stitch type selection keys 103 was selected (YES at Step S13), the selected stitch type display 121 is displayed on the liquid crystal display 15 (Step S14). For example, in a case where the stitch type selection key 103 for the category number-sub-category number 1-16 was selected from among the stitch type selection keys 103, the stitch type data table that is stored in the EEPROM 64 is read and is stored in the RAM 63. Based on the stitch type pattern data that is associated with the category number 1 and the sub-category number 16 among the data that is stored in the stitch type data table, the selected stitch type display 121 is displayed on the liquid crystal display 15, as shown in FIG. 6 (Step S14). Information on the distance between the reference position 123 and the selected stitch type display 121 (the same distance as the distance between the reference position 123 and the planned stitch type 86) is also included in the stitch type pattern data. When the selected stitch type display 121 is displayed, the selected stitch type display 121 is separated from the reference position 123 by a distance (the number of pixels that corresponds to a distance) that is based on the information about the distance from the reference position 123. Therefore, the distance between the reference position 123 and the selected stitch type display 121 that is shown in FIG. 6 is the same as the distance between the reference position 123 and the planned stitch type 86 that is shown in FIG. 11.

The category number, the sub-category number, and the stitch type name are displayed in the selected stitch type display field 120 (Step S15). For example, at Step S15, the stitch type data table that is stored in the RAM 63 is referenced, and the category number-sub-category number 1-16 and the stitch type name "1-16 Overcasting stitch" are displayed in the selected stitch type display field 120, as shown in FIG. 6. The presser foot code 124 is displayed on the liquid crystal display 15 (Step S16). For example, at Step S16, the presser foot code 124 that indicates the type of the presser foot 30 is displayed based on the type of the presser foot 30 in the stitch type data table that is stored in RAM 63, as shown in FIG. 6. In FIG. 6, the presser foot code 124 that indicates the J presser foot is displayed. Each of the displays that are displayed at Steps S14 to S16 is displayed on the liquid crystal display 15 at approximately the same time that the touch panel 26 detects the pressing operation by the user. Therefore, the user can visually recognize that each of the displays is displayed at the same time as the pressing operation is performed on the touch panel 26. The processing returns to Step S12.

At Step S13, in a case where none of the stitch type selection keys 103 has been selected (NO at Step S13), it is determined whether the mark key 129 was selected by the panel operation that was detected at Step S12 (Step S17). In a case where the mark key 129 was selected (YES at Step S17), mark display processing is performed (Step S18).

Figure 10:
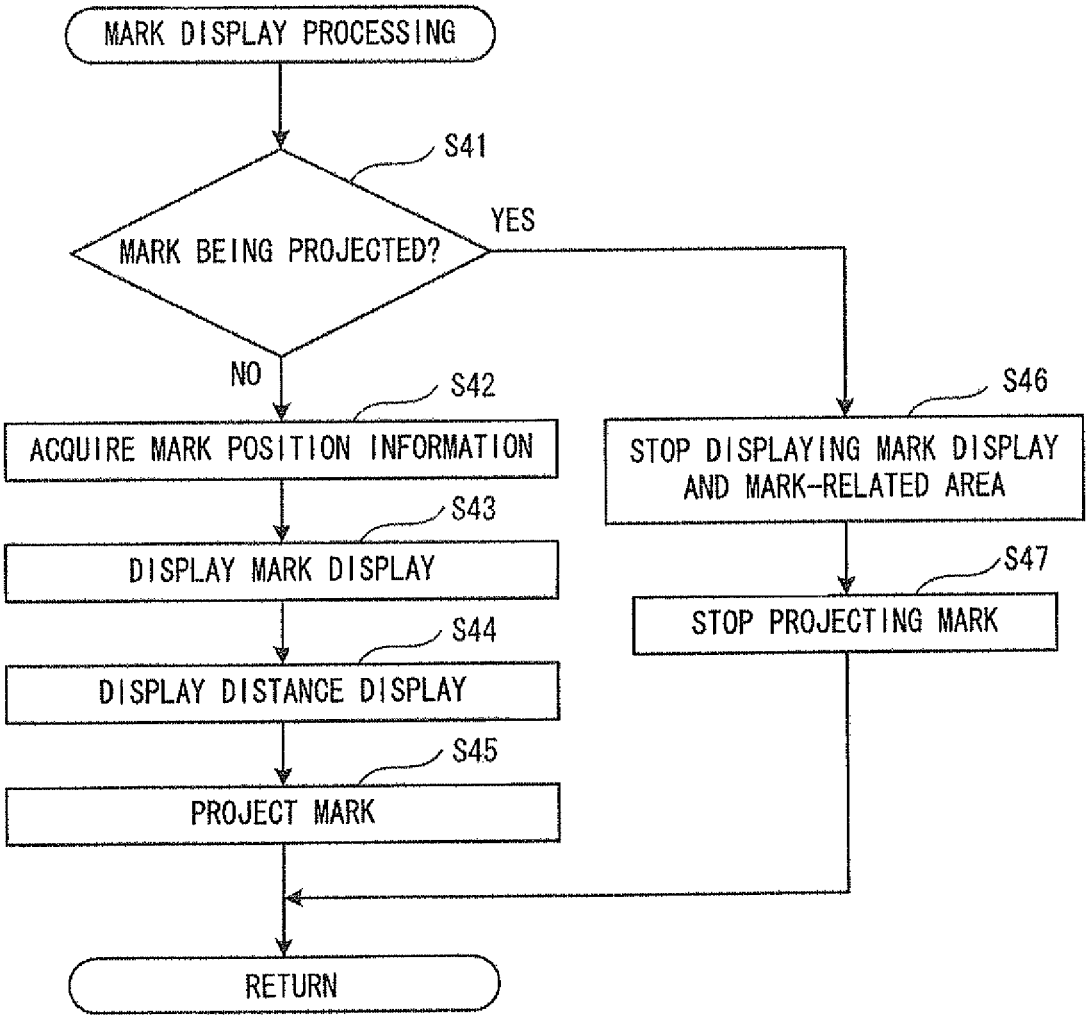
FIG. 10 is a flowchart of mark display processing.

The mark display processing will be explained with reference to FIG. 10. The mark display processing is processing that switches between the displaying of the mark display 122 in conjunction with the projecting of the mark 83 and the hiding of the mark display 122 in conjunction with the stopping of the projection of the mark 83. As shown in FIG. 10, in the mark display processing, the CPU 61 determines whether the mark 83 is currently being projected (Step S41). In a case where the mark 83 is not currently being projected (NO at Step S41), mark position information is acquired (Step S42). The mark position information is information that indicates the distance between the mark 83 that to be projected from the projection mechanism 22 (refer to FIG. 11) and the reference position 123 on one of the top face of the sewing machine bed 11 and the work cloth 85 that is placed on top of the top face of the sewing machine bed 11 (refer to FIG. 11). The initial value of the mark position information is zero millimeters. That is, in a case where the mark position information is at its initial value, the position where the mark 83 is projected coincides with the reference position 123. The initial value of the mark position information may be stored in the EEPROM 64. When the movable carriage 24 of the projection mechanism 22 is moved, and the position where the mark 83 to be projected is moved, the most recent mark position information is updated and stored in the EEPROM 64 (Steps S23 and S28 in FIG. 9, described later). Therefore, at Step S42, the distance between the reference position 123 and the mark 83 is acquired by reading the mark position information (that is, the distance between the reference position 123 and the mark 83) that is stored in the EEPROM 64.

The mark display 122 is displayed on the liquid crystal display 15 (Step S43). At Step S43, based on the mark position information that was acquired at Step S42, the mark display 122 is displayed such that the mark display 122 is separated from the reference position 123 by the distance (the number of pixels that corresponds to the distance) between the reference position 123 (refer to FIG. 11) and the mark 83 that is projected from the projection mechanism 22. For example, in a case where the mark position information is 7 millimeters, the mark display 122 is displayed at a position that is 7 millimeters to the right of the reference position 123, as shown in FIG. 7 (Step S43). The mark-related area 255 is displayed, and based on the mark position information that was acquired at Step S42, the distance between the reference position 123 and the mark 83 is displayed in the distance display 256 (Step S44). Thus the mark-related area 255 is displayed, and "7.0 mm" is displayed in the numerical value display 257 of the distance display 256, as shown in FIG. 7, for example. The projection position display 259 of the scale display 258 is displayed at the position of the 7 millimeters scale mark.

The projection mechanism 22 is controlled such that the mark 83 is projected onto at least one of the top face of the sewing machine bed 11 and the work cloth 85 that is placed on top of the top face of the sewing machine bed 11 (Step S45). For example, the mark 83 is projected 7 millimeters to the right of the reference position 123, as shown in FIG. 11. FIG. 11 shows an example of a case in which the planned stitch type 86 to be sewn slightly to the left of a right edge 851 of the work cloth 85. The mark 83 is projected onto the top face of the sewing machine bed 11 at a position to the right of the right edge 851 of the work cloth 85.

As shown in FIG. 7, the distance between the selected stitch type display 121 (the left edge of the selected stitch type display 121) and the mark display 122 is 5 millimeters. As shown in FIG. 11, the distance between the position where the planned stitch type 86 to be sewn and the position where the mark 83 is projected is also 5 millimeters. That is, in the processing at Step S43, the mark display 122 and the selected stitch type display 121 are displayed on the liquid crystal display 15 in the same positional relationship as the positional relationship between the position of the mark 83 that is projected onto one of the top face of the sewing machine bed 11 and the work cloth 85 that is placed on top of the top face of the sewing machine bed 11 and the position where the planned stitch type 86 that was selected by the panel operation at Step S13 to be sewn. Therefore, the user can easily recognize the positional relationship between the planned stitch type 86 and the mark 83 that is projected onto one of the top face of the sewing machine bed 11 and the work cloth 85 by checking the positional relationship between the mark display 122 and the selected stitch type display 121 that are displayed on the liquid crystal display 15 (refer to FIG. 7). Thus, the user can easily recognize the sewing to be performed in relation to the projected mark 83, which improves the operating efficiency when the sewing is performed by making it easier to position the work cloth 85. Each of the displays that are displayed at Steps S43, S44 is displayed on the liquid crystal display 15 at approximately the same time that the touch panel 26 detects the pressing operation by the user. Therefore, the user can visually recognize that each of the displays is displayed at the same time as the pressing operation is performed on the touch panel 26. The processing at Steps S46 and S47 will be described later. After Step S45 is performed, the mark display processing is ended, and the processing returns to Step S12 of the main processing.

As shown in FIG. 9, in a case where the mark key 129 has not been selected (NO at Step S17), it is determined whether the plus key 263 of the projection position adjustment keys 262 was selected by the panel operation that was detected at Step S12 (Step S19). In a case where the plus key 263 was selected (YES at Step S19), the position of the mark display 122 is moved 0.5 millimeters to the right (to the right by the number of pixels that corresponds to 0.5 millimeters), and the mark display 122 is displayed on the liquid crystal display 15 (Step S20). In the distance display 256, 0.5 millimeters is added to the value that was being displayed immediately before the plus key 263 was selected, and the distance display 256 is re-displayed (Step S21). The movable carriage 24 of the projection mechanism 22 is moved 0.5 millimeters to the right, and the projection position for the mark 83 is moved 0.5 millimeters to the right (Step S22). The equivalent of 0.5 millimeters is added to the mark position information that is stored in the EEPROM 64, and the updated mark position information is stored (Step S23). The processing returns to Step S12.

In a case where the plus key 263 has not been selected (NO at Step S19), it is determined whether the minus key 264 of the projection position adjustment keys 262 was selected by the panel operation that was detected at Step S12 (Step S24). In a case where the minus key 264 was selected (YES at Step S24), the position of the mark display 122 is moved 0.5 millimeters to the left (to the left by the number of pixels that corresponds to 0.5 millimeters), and the mark display 122 is displayed on the liquid crystal display 15 (Step S25). In the distance display 256, 0.5 millimeters is subtracted from the value that was being displayed immediately before the minus key 264 was selected, and the distance display 256 is re-displayed (Step S26). The movable carriage 24 of the projection mechanism 22 is moved 0.5 millimeters to the left, and the projection position for the mark 83 is moved 0.5 millimeters to the left (Step S27). The equivalent of 0.5 millimeters is subtracted from the mark position information that is stored in the EEPROM 64, and the updated mark position information is stored (Step S28). The processing returns to Step S12. Each of the displays that are displayed at Steps S20 and S21 is displayed on the liquid crystal display 15 at approximately the same time that the pressing operation on the touch panel 26 is performed by the user. Similarly, each of the displays that are displayed at Steps S25 and S26 is displayed on the liquid crystal display 15 at approximately the same time that the pressing operation on the touch panel 26 is performed by the user.

Figure 12:
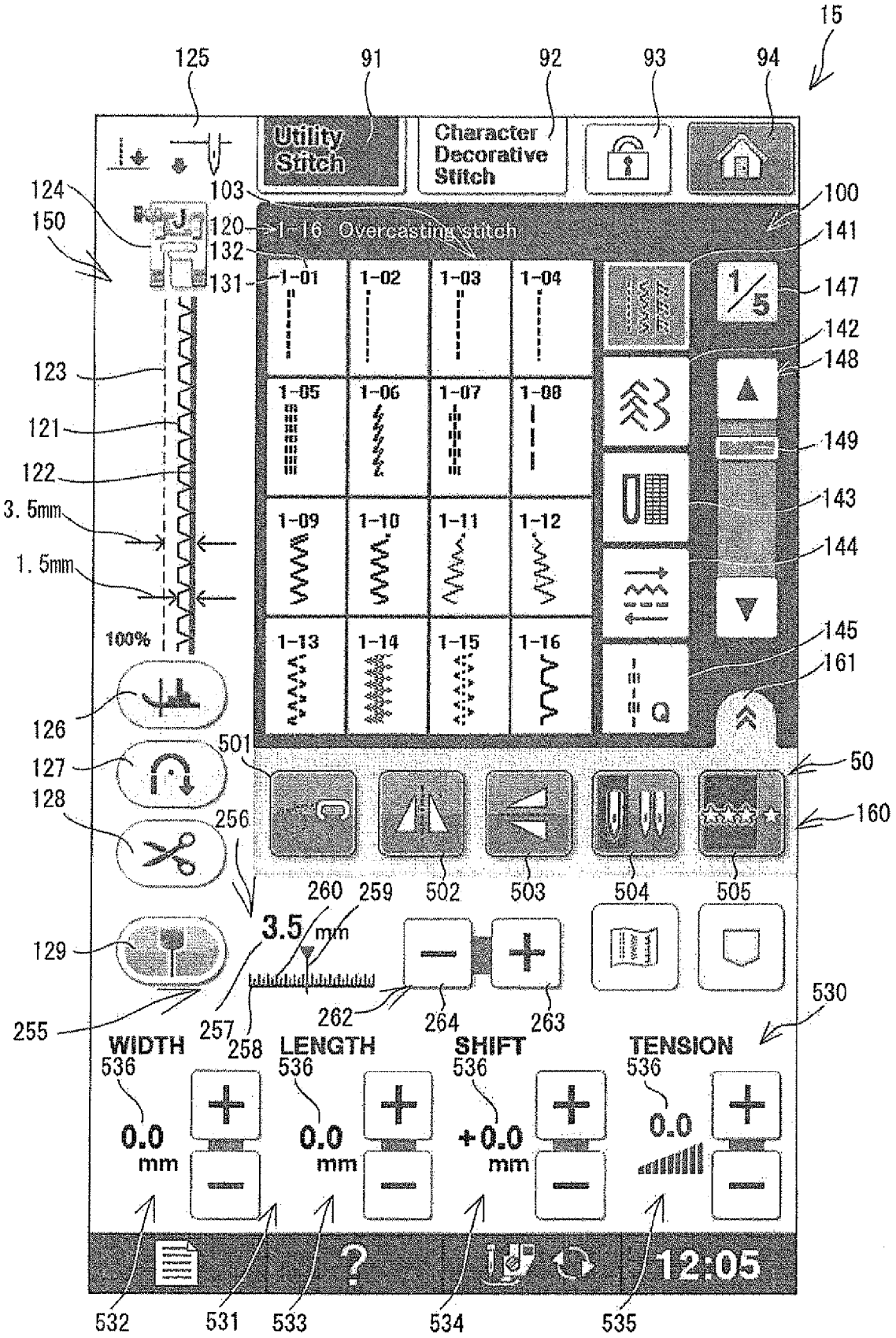
FIG. 12 is a figure that shows a state in which a mark display that is shown in FIG. 7 has been moved 3.5 millimeters to the left.
Figure 13:
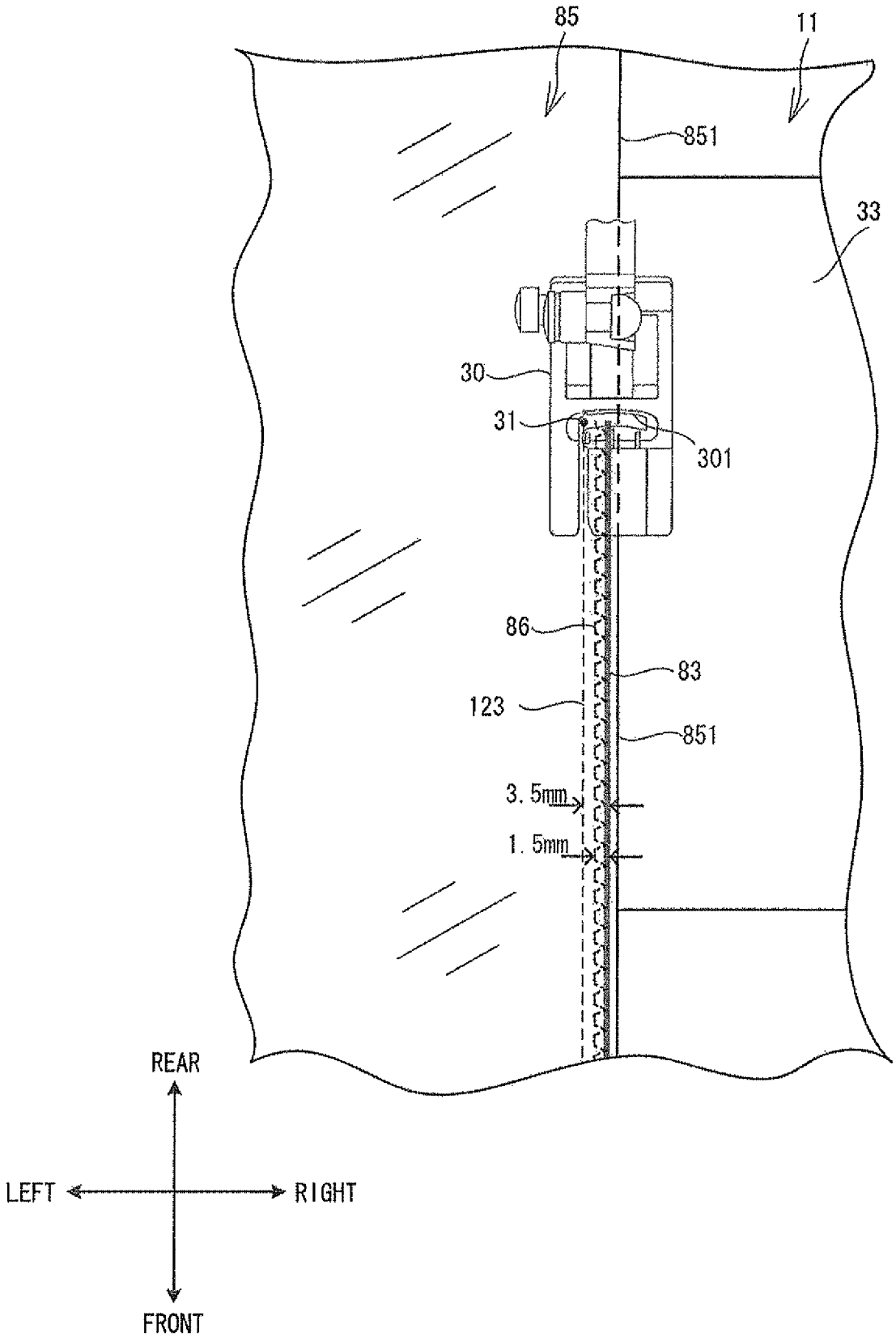
FIG. 13 is a figure that shows a state in which the mark that is shown in FIG. 11 has been moved 3.5 millimeters to the left.

For example, in a case where the minus key 264 is selected seven times in succession (an operation that moves the projection position 3.5 millimeters to the left), the processing at Steps S25 to S28 is performed seven times. In that case, as shown in FIG. 12, the mark display 122 is moved 3.5 millimeters to the left and is displayed (Step S25). The mark display 122 is positioned 3.5 millimeters to the right of the reference position 123. The numerical value display 257 of the distance display 256 displays "3.5 mm", and the projection position display 259 of the scale display 258 is displayed at the position of the 3.5 millimeters scale mark (Step S26). As shown in FIG. 13, the projection position for the mark 83 is moved 3.5 millimeters to the left (Step S27). The mark 83 is projected onto the work cloth 85 at a position that is 3.5 millimeters to the right of the reference position 123. As a result, the distance between the selected stitch type display 121 (the left edge of the selected stitch type display 121) and the mark display 122 becomes 1.5 millimeters (refer to FIG. 12). As shown in FIG. 13, the distance between the position where the planned stitch type 86 to be sewn and the position where the mark 83 is projected also becomes 1.5 millimeters.

In a case where the minus key 264 has not been selected (NO at Step S24), processing is performed that corresponds to the key that was selected (Step S29). For example, in a case where the function key 502 (the left-right inversion key) was selected, the selected stitch type display 121 is inverted left to right, and the planned stitch type 86 is also inverted left to right. The processing returns to Step S12. Note that in the state that is shown in FIG. 13, for example, in a case where the sewing start/stop switch that is included in the switch cluster 21 has been pressed, sewing the planned stitch type 86 on the work cloth 85 starts.

In a case where the mark key 129 is selected by a panel operation while the mark 83 is being projected (YES at Step S12; YES at Step S17), it is determined that the mark 83 is currently being projected (YES at Step S41), as shown in FIG. 10. Next, the mark display 122 and the mark-related area 255 that were being displayed on the liquid crystal display 15 are hidden (Step S46). This causes the liquid crystal display 15 to change from the state that is shown in FIG. 12, for example, to the state that is shown in FIG. 6. As shown in FIG. 6, the mark display 122 is hidden, and the mark-related area 255 is hidden, so the distance display 256 and the projection position adjustment keys 262 are hidden (Step S46). Next, the projection mechanism 22 is controlled such that the projecting of the mark 83 is stopped (Step S47). The mark display processing is ended, and the processing returns to Step S12 of the main processing.

The processing in the present embodiment is performed as described above. Note that in a case where the power supply to the sewing machine 1 is turned off, the main processing is ended.

In the present embodiment, in a case where the plus key 263 was selected by the panel operation (YES at Step S19), the display position of the mark display 122 and the projection position for the mark 83 are both moved (changed) 0.5 millimeters to the right (Steps S20 and S22). Similarly, in a case where the minus key 264 was selected by the panel operation (YES at Step S24), the display position of the mark display 122 and the projection position for the mark 83 are both moved (changed) 0.5 millimeters to the left (Steps S25 and S27). In other words, in a case where the projection position for the mark 83 is changed at Steps S22 and S27, the sewing machine 1 can display the mark display 122 and the selected stitch type display 121 on the liquid crystal display 15 with the same positional relationship as the positional relationship between the position of the mark 83 after the change and the position where the planned stitch type 86 to be sewn (Steps S20 and S25). Therefore, by checking the positional relationship between the mark display 122 and the selected stitch type display 121 after their positions have been changed, the user can easily recognize the positional relationship between the mark 83 and the planned stitch type 86 after their positions have been changed. Accordingly, even in a case where the position of the projected mark 83 has been changed, the user can easily recognize how the sewing to be performed in relation to the projected mark 83, making it easier to position the work cloth 85. Therefore, the operating efficiency when the sewing is performed is improved.

The distance display 256 is displayed on the liquid crystal display 15 (Steps S21, S26, and S44). In a case where the distance display 256 indicates 7.0 millimeters, for example, the user can recognize that the distance between the reference position 123 and the mark 83 is 7.0 millimeters by visually checking the distance display 256. The user can also easily recognize the projected mark 83 and the position of the reference position 123 on one of the work cloth 85 and the top face of the sewing machine bed 11. Therefore, the user can easily recognize how the planned stitch type 86 to be sewn in relation to the reference position 123 and the position of the projected mark 83, so the operating efficiency when the sewing is performed is improved even more.

In a case where the user selects the mark key 129 by a panel operation while the mark 83 is not being projected, the mark display 122 is displayed (Step S43), and the mark 83 is projected (Step S45). In a case where the user selects the mark key 129 by a panel operation while the mark 83 is being projected, the mark display 122 is hidden (Step S46), and the projecting of the mark 83 stops (Step S47). In other words, the sewing machine 1 can switch between displaying and hiding the mark display 122 in conjunction with the switching between the case in which the mark 83 to be projected and the case in which the mark 83 is not to be projected. Therefore, the user can recognize whether the mark 83 is being projected just by checking the liquid crystal display 15. That means that it is not necessary for the user to recognize whether the mark 83 is being projected by looking directly at the one of the work cloth 85 and the top face of the sewing machine bed 11. Thus, the operating efficiency when the sewing is performed is improved even more.

The user can select any stitch type for which the sewing to be performed by selecting one of the stitch type selection keys 103, by a panel operation. The selected stitch type display 121 for the stitch type that has been selected by the user is displayed on the liquid crystal display 15. That makes it possible for the user to easily recognize the shape of the selected stitch type to be sewn in relation to the mark 83.

The presser foot code 124 may be displayed on the liquid crystal display 15 (Step S16). Therefore, in addition to the previously described effects that make it possible to position the work cloth 85 easily, the user can easily recognize the type of the presser foot 30 that to be mounted on the needle bar in order to sew the planned stitch type 86 that has been selected, just by checking the presser foot code 124. That makes it possible for the user to smoothly prepare the presser foot 30 of the type that is to be used for the sewing. The operating efficiency when the sewing is performed is thus improved even more.

Note that the present disclosure is not limited to the embodiment that has been described above, and various types of modifications can be made. For example, the shape of the mark 83 is a straight line, but is not limited to that shape. The mark 83 may be a in the shape of a plus mark, for example. In that case, the shape of the mark display 122 should also be a plus mark.

In the case where the mark key 129 was selected by the panel operation (YES at Step S17), the switch has been made between the case in which the mark 83 to be projected and the case in which the mark 83 is not to be projected (Steps S45 and S47). However, the operation for switching between the cases in which the mark 83 to be projected and the case in which the mark 83 is not to be projected is not limited to this example. For example, in a case where a mechanical switch is provided on the arm 13 of the sewing machine 1, the switching between the case in which the mark 83 to be projected and the case in which the mark 83 is not to be projected may also be performed by turning the mechanical switch on and off, instead of by using a panel operation to select the mark key 129.

The distance display 256 includes the numerical value display 257 and the scale display 258, but is not limited to this configuration. For example, it is acceptable to display only one of the numerical value display 257 and the scale display 258 as the distance display 256. It is also acceptable not to display the distance display 256.

The position where the mark 83 is projected can be moved to the left and to the right, but it is not limited to those directions. For example, the position where the mark 83 is projected may be moved toward the front and toward the rear. It is also acceptable for the position where the mark 83 is projected not to be moved. The projection mechanism 22 is also not limited to above-described configuration, as long as it is configured to project the mark 83. The projection mechanism 22 may also have a configuration that is configured to change the position of the mark 83 by using a motor to control the angle of the laser emitter 250.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a display configured to display display information related to sewing;

a projection portion configured to project a mark having a predetermined shape toward a sewing machine bed, wherein the sewing machine bed includes a needle plate;

a processor; and a memory configured to store computer-readable instructions therein that, when executed by the processor, cause the sewing machine to:

project, by the projection portion, the mark toward the sewing machine bed; and display, by the display, mark display information that represents the mark and stitch type display information of a planned stitch type to be sewn, such that the mark display information is separated from the stitch type display information by a first distance that corresponds to a second distance between the position of the planned stitch type to be sewn and the position of the mark configured to be projected on the sewing machine bed, wherein the stitch type display information represents a shape of a stitch type.

2. The sewing machine according to claim 1, wherein the computer-readable instructions further cause the sewing machine to:

change the position of the mark projected by the projection portion, wherein the displaying the mark display information and the stitch type display information by the display includes:

displaying, by the display, the mark display information and the stitch type display information, such that the mark display information is separated from the stitch type display information by the first distance that corresponds to the second distance between the position of the planned stitch type to be sewn and the position of the mark on the sewing machine bed after changing the position of the mark.

3. The sewing machine according to claim 1, wherein the computer-readable instructions further cause the sewing machine to:

acquire a third distance between the mark configured to be projected on the sewing machine bed by the projection portion and a predetermined reference position on the sewing machine bed; and display distance information indicating the third distance.

4. The sewing machine according to claim 1, wherein the computer-readable instructions further cause the sewing machine to:

switch between projecting the mark by the projection portion and not projecting the mark by the projection portion, wherein the displaying the mark display information and the stitch type display information by the display includes:

displaying the mark display information and the stitch type display information by the display in response to switching to projecting the mark by the projection portion, and not displaying the mark display information by the display in response to switching to not projecting the mark by the projection portion.

5. The sewing machine according to claim 1, wherein, the memory is further configured to store a plurality of stitch type display data items and a plurality of stitch type data items respectively associated with each other as correspondence data, wherein each of the plurality of stitch type display data items represents data for displaying the stitch type display information by the display, and each of the plurality of stitch type data items represents data for sewing a stitch type; and the computer-readable instructions further cause the sewing machine to:

select a stitch type data item for the planned stitch type from the plurality of stitch type data items, wherein the displaying the mark display information and the stitch type display information by the display includes:

displaying the stitch type display information by the display based on one stitch type display data item of the plurality of stitch type display data items, wherein the one stitch type display data item is associated with the selected stitch type data item in response to selecting the stitch type data item.

6. The sewing machine according to claim 5, wherein the memory is further configured to store a plurality of presser foot type data items further respectively associated with the plurality of stitch type data items in the correspondence data, wherein each of the plurality of presser foot type data items represents a type of a presser foot configured to be used when a stitch type is sewn based on each of the plurality of stitch type data items, and the computer-readable instructions further cause the sewing machine to:

display a type of the presser foot by the display, based on one presser foot type data item of the plurality of presser foot type data items, wherein the one presser foot type data item is associated with the selected stitch type data item.

* * * * *